US005972165A

United States Patent [19]

Sethna et al.

[11] Patent Number: 5,972,165

[45] **Date of Patent: *Oct. 26, 1999**

[54] METHOD OF PRODUCING OXIDIZED WHITE LIQUOR USING DREGS CONTAINING CARBON PARTICLES

[75] Inventors: Rustam H. Sethna, New Brunswick; Mark J. Kirschner, Morristown, both of N.J.

[73] Assignee: The BOC Group, Inc., New Providence, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/785,262

[22] Filed: Jan. 17, 1997

[51] Int. Cl.[6] ..... D21C 11/04

[52] U.S. Cl. ..... 162/30.11; 162/29; 423/551; 423/564; 423/566.2

[58] Field of Search ..... 162/29, 30.11; 422/185; 423/551, 562, 564.2, 566.2, 566.3

[56] References Cited

U.S. PATENT DOCUMENTS

| | | | |
|---|---|---|---|
| 3,650,889 | 3/1972 | Fogman et al. | 162/30 |
| 3,860,479 | 1/1975 | Barker et al. | 162/79 |
| 4,036,942 | 7/1977 | Sibeud et al. | 423/573 |
| 5,082,526 | 1/1992 | Dorris | 162/30.11 |
| 5,378,320 | 1/1995 | Leclerc et al. | 162/49 |
| 5,500,085 | 3/1996 | Magnotta et al. | 162/30.11 |

OTHER PUBLICATIONS

O'Hern, H.A., "Product Distribution . . . Green Liquor Oxidation"., pp. 139–151, Oct. 1972.

Kenneth Y. Chen, "Environ. Sci. Technology 1972, 6, 529," Kinetics of Oxidation of Aqueous Sulfide by O2, (Jun. 10, 1972).

Pal, S.K, Sharma, M.M. and Juvekar, V.A., "Chem Eng. Sci., vol. 37 No. 2 pp. 327–336, 1982," Fast Reactions in Slurry Reactors: Catalyst particle Size Smaller Than Film Thickness: Oxidation of Aqueous Sodium Solphide Solutions with Activated Carbon Particles As Catalyst At Elevated Temperatures, Department of Chemical Technology University of Bombay (Matunga, Bombay India), vol. 37 (No. 2), (Jul. 6, 1981).

*Primary Examiner*—Dean T. Nguyen

*Attorney, Agent, or Firm*—David M. Rosenblum; Salvatore P. Pace

[57] ABSTRACT

White liquor produced from black liquor is partially or completed oxidized. The white liquor contains dregs that are utilized as a carbon based catalyst. Dregs are produced by separating the dregs from green liquor an intermediate product between the black liquor and the oxidized white liquor. After formation of the oxidized white liquor, the dregs are separated therefrom to form a waste dreg stream which can be recycled so that part of the dregs present within the dregs containing white liquor stream to be oxidized is contributed by the waste dreg stream.

14 Claims, 1 Drawing Sheet

METHOD OF PRODUCING OXIDIZED WHITE LIQUOR USING DREGS CONTAINING CARBON PARTICLES

BACKGROUND OF THE INVENTION

The present invention relates to a method of producing oxidized white liquor in which the white liquor to be oxidized is formed from green liquor. More particularly the present invention relates to such a process in which dregs are separated from the green liquor and then are added to the white liquor to enhance the oxidation rate of the white liquor.

Wood pulp is processed into paper by digesting the wood pulp in a digester to which white liquor has been added. White liquor is an aqueous mixture of sodium sulfide and sodium hydroxide. Brown pulp stock, produced from the digestion of the wood pulp, is further delignified in a process known as oxygen delignification and then bleached in a series of stages which may use peroxide, ozone, or chlorine dioxide bleaching. White liquor is oxidized in order to deactivate the sodium sulfide which would otherwise react with the aforementioned bleaching agents. The degree of oxidation can be partial or complete and as such sulfides can be converted to thiosulfate or sulfate. The oxidized white liquor can then be used as a caustic source in the oxygen delignification process or the peroxide bleaching stages (peroxide bleaching would require complete oxidation or sodium sulfate) that are often provided prior to a chlorine dioxide bleaching stage.

A practical problem involved in the production of oxidized white liquor concerns the reaction time required to allow the oxidation of the sodium sulfide to go to the desired level of completion. Under ambient conditions, several hours are required to partly oxidize sodium sulfide and even longer time periods are required to produce sodium sulfate. Since large hydraulic retention times require a large capital investment, oxidized white liquor must be produced more rapidly than is possible under ambient conditions to make the use of oxidized white liquor economically feasible.

It has been found that the oxidation rate of white liquor can be accelerated by conducting the reactions at higher than ambient temperatures and pressures. In U.S. Pat. No. 5,500,085 white liquor is oxidized within a stirred reactor at a temperature range at between 180° F. and 300° F. and a pressure range of between 100 and 300 psig. As described in 37 Chemical Engineering Science, No. 2, pp. 327–336, Fast Reactions in Slurry Reactors: Catalyst Particle Size Smaller Than Film Thickness: Oxidation Of Aqueous Sodium Sulfide Solutions With Activated Carbon Particles As Catalyst At Elevated Temperatures, Sharma et al. (1982), an activated carbon catalyst added to aqueous sodium sulfide solutions will also reduce reaction times. The efficiency at which oxygen and white liquor are contacted with one another will also influence reaction time. In this regard, U.S. Pat. No. 5,439,556 illustrates a plug flow reactor employing structured packing that effects a reduction in reaction times by forming a descending film of the white liquor that contacts an ascending vapor containing the oxygen.

As will be discussed, the present invention provides method of oxidizing white liquor that is integrated into a pulping process to either partially or fully oxidize white liquor under practical reaction times.

SUMMARY OF THE INVENTION

The present invention provides a method of producing oxidized white liquor from black liquor comprising converting the black liquor into green liquor and then converting the green liquor into white liquor. Dregs are separated from the green liquor and the dregs are concentrated to produce a solid component and an aqueous solution containing the dregs. The streams of the aqueous solution and white liquor are combined to produce a dreg containing white liquor stream. The dreg containing white liquor stream is oxidized to produce the oxidized white liquor.

In another aspect of the present invention, a dreg containing white liquor stream formed from white liquor is oxidized to produce oxidized white liquor. The dregs are separated from oxidized white liquor to form a waste dreg stream. At least part of the waste dreg stream is recycled so that part of the dregs presents within the dreg containing white liquor stream is contributed by the waste dreg stream.

In the conversion of black liquor to green liquor, the black liquor is burned as a fuel in a boiler. This produces particles of char within the green liquor which are separated out. It is important that dregs be separated out of the liquor because the entire pulping and paper making process involves producing a uniform pulp. If dregs remain in the white liquor, the dregs will contaminate the pulp and will contaminate the paper product.

In order to prevent this, the white liquor is recovered from green liquor only after the green liquor has been treated by a dregs precoat filter to remove the dregs. The present invention, unlike the prior art, uses a portion of the dregs that are produced and used such dregs as a catalyst to enhance the oxidation of the sulfides to either thiosulfate or sulfates. As described above, although there exists experimental data of using activated carbon for such purpose, that is carbon having a very high surface area, there is no data to support the use of dregs for supplying finely divided carbon particles that can act as a catalyst. On this point, the only teaching of the prior art is to remove and dispose of the dregs rather than advantageously utilize it to catalyze the oxidation of white liquor.

BRIEF DESCRIPTION OF THE DRAWINGS

While the specification concludes with claims distinctly pointing out the subject matter that applicants regard as their invention, it is believed that the invention will be better understood when taken in connection with the accompanying drawings in which:

DETAILED DESCRIPTION

Figures 1, 2:
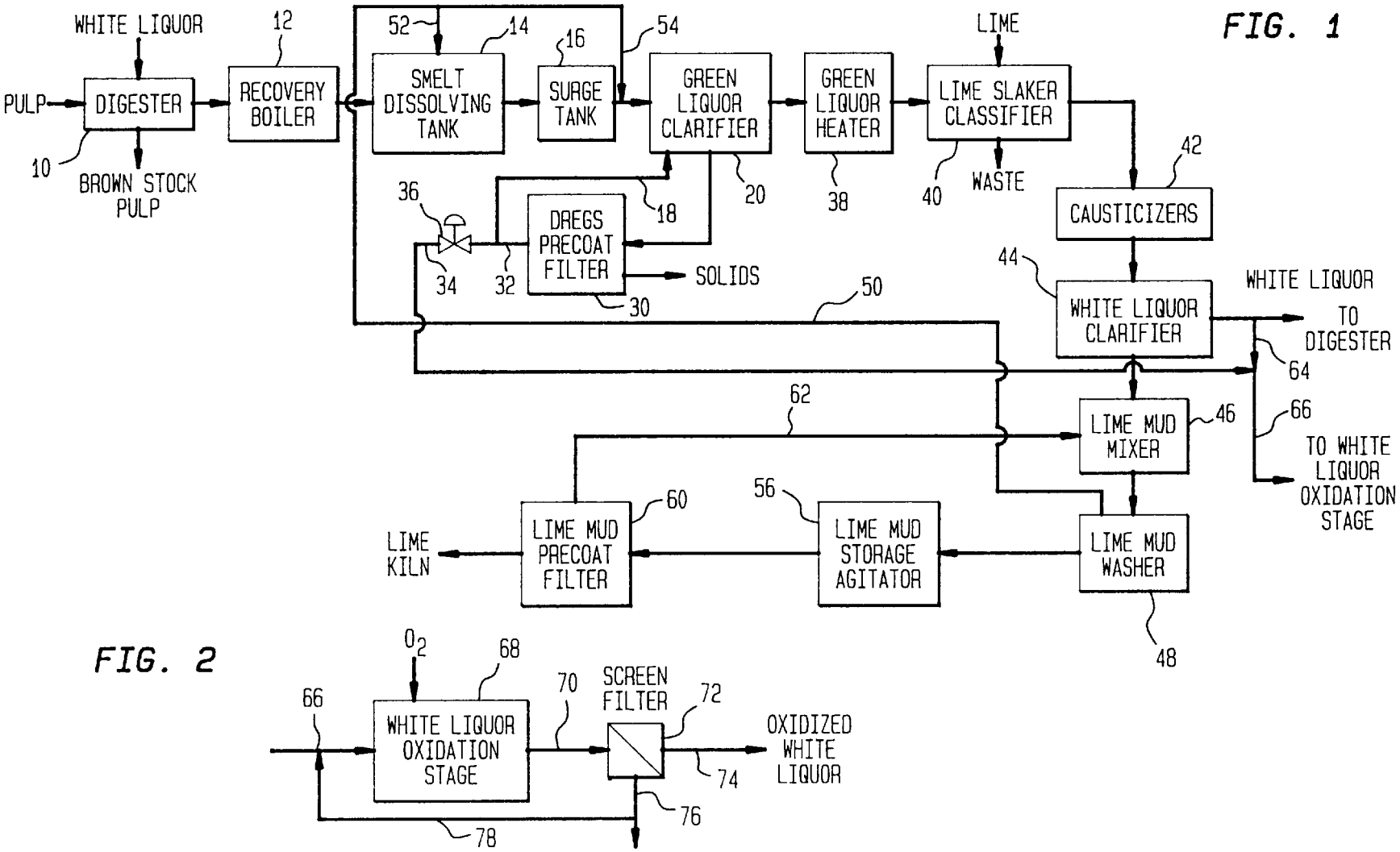
FIG. 1 is a schematic view of an apparatus for carrying out a method in accordance with the present invention.
FIG. 2 is a schematic view of a white liquor oxidation stage in accordance with the present invention.

With reference to FIG. 1, pulp is digested into brown stock pulp and the resulting black liquor is recovered and refined into white liquor to be used in the digestion of the wood pulp.

White liquor and wood chips are introduced into a digester 10 to produce brown stock pulp and black liquor which is burned in a recovery boiler 12 to produce a smelt that contains char, sodium carbonate and sodium sulfide. The smelt is introduced with water into a smelt dissolving tank 14. The resultant aqueous solution is introduced into a surge tank 16 and then along with a water return stream 18 is introduced into the green liquor clarifier 20 which is simply a settling tank in which dregs settle to the bottom. The dregs form a residue that is extracted from green liquor clarifier 20 and then concentrated within a dregs precoat filter 30. After filtering, an aqueous solution results that is withdrawn from precoat filter 30 as an aqueous stream 32. Aqueous stream 32 is in part used in forming water return stream 18. A stream 34 is formed from a remainder of aqueous stream 32 after water return stream 18 has been divided therefrom. Stream 34 can be metered by a proportional valve 36.

The green liquor produced within green liquor clarifier 20 is heated in a green liquor heater 38 and thereafter, is introduced into a lime slaker classifier 40 along with lime from a lime kiln to causticize the green liquor. The green liquor is then circulated within causticizers 42 which consists of settling tanks in which solution is recirculated in order to increase and stabilize the sodium hydroxide concentration. The resultant causticized mixture is introduced into a white liquor clarifier 44 which is a settling tank from which white liquor is withdrawn. As will be discussed, part of the white liquor is recirculated back to digester 10 while a remaining part can be partially or completed oxidized in a white liquor oxidation stage.

The residue of white liquor clarifier 44 is pumped to lime mud mixer 46. An aqueous solution is then introduced into lime mud washer 48. Wash water as a wash water stream 50 (which contains sodium carbonate) is introduced in part into smelt dissolving tank 14 as a stream 52 and in part into green liquor clarifier 20 as a stream 54.

Lime mud is introduced into a lime mud agitator 56 to keep the lime mud from agglomerating and an aqueous component thereof is filtered in a lime mud precoat filter 60. The resultant aqueous stream 62 produced by the filtration of the lime mud is recirculated back to lime mud mixer 46. The lime mud produced by lime mud precoat filter 60 is introduced into the lime kiln.

In white liquor oxidation stage, aqueous stream 34 is combined with a white liquor stream 64 to produce a dreg containing white liquor stream 66. It is this stream that is oxidized within white liquor oxidation stage 68. In a manner known in the art, the white liquor is either fully oxidized so that the sodium sulfide is converted to sodium sulfate or is partially oxidized so that the sodium sulfide becomes sodium thiosulfate. The oxidized stream 70 that is produced is then filtered in a screen filter 72 so that the oxidized white liquor stream 74 is essentially free of char particles. The rejected stream 76 can either be disposed of or, as illustrated, can be in part as a stream 78 recirculated back to add char particles to dreg containing white liquor stream 66.

Preferably, the dreg concentration in dreg containing white liquor stream 66, as that stream is introduced in white liquor oxidation stage 68, should contain no more than 10 grams per liter of dregs. The dreg content should be between about 1 and about 10 grams per liter. It has been found by the inventors herein that a dreg concentration above 10 grams per liter does not produce any appreciable reduction in reaction times. Dreg content can be controlled by metering aqueous stream 34 through control valve 36. Additionally, a separate control involves the degree to which stream 78 is recirculated, if present.

White liquor oxidation stage 68 can be a stirred reactor or, more preferably, a packed column. The use of pipe line reactors are well known in the art for partial white liquor oxidation.

It has been found by the inventors herein that the reaction temperature for complete white liquor oxidation (that is oxidation of sodium sulfide to sodium sulfate) should be between about 120° C. and about 180° C. and the pressure should be between about 120 psig to about 250 psig. For such purpose, 170° C. is a preferred temperature and a preferred pressure range is between about 180 psig and about 250 psig. 250 psig has been found to be a particularly preferred pressure. For partial white liquor oxidation (that is oxidation of sulfide to thiosulfate,) temperatures of between about 60° C. and about 110° C. and pressures of between about 70 psig and about 100 psig are operable. A preferred pressure and temperature has been found to be 100° C. and a pressure of about 100 psig.

Although the present invention has been described by reference to a preferred embodiment, as will occur to those skilled in the art, numerous changes, additions and omissions may be made without departing from the spirit and scope of the present invention.

We claim:

1. A method of producing oxidized white liquor from black liquor comprising:

converting said black liquor into a white liquor stream having dregs containing carbon particles; and oxidizing said dreg containing white liquor stream to produce an oxidized white liquor.

2. A method of producing oxidized white liquor from black liquor comprising:

converting said black liquor to green liquor;

separating dregs containing carbon particles from said green liquor;

concentrating said dregs to produce a solid component and an aqueous solution containing said dregs;

converting said green liquor into said white liquor;

combining streams of said aqueous solution and said white liquor to produce a white liquor stream having dregs containing carbon particles; and oxidizing said dreg containing white liquor stream to produce an oxidized white liquor.

3. A method of oxidizing white liquor containing dregs comprising:

oxidizing a white liquor stream having dregs containing carbon particles to produce an oxidized white liquor;

separating said dregs from said oxidized white liquor to form a waste dreg stream; and recycling at least part of said waste dreg stream to said white liquor stream so that part of said dregs present within said dreg containing white liquor stream is contributed by said waste dreg stream.

4. The method of claim 2 or claim 1, further comprising:

separating said dregs from said oxidized white liquor to form a waste dreg stream; and recycling at least part of said waste dreg stream to said white liquor stream so that part of said dregs present within said dregs containing white liquor stream is contributed by said waste dreg stream.

5. The method of claim 4, wherein said dregs are present within said dreg containing white liquor stream at a concentration of no more than about 10.0 grams/liter.

6. The method of claim 5, wherein said oxidizing is at a temperature of between about 120° C. to about 180° C. and at a pressure of between about 120 and 250 psig and such that sodium sulfide content of said dreg containing white liquor is substantially converted to sodium sulfate.

7. The method of claim 5, wherein said oxidizing is at a temperature of about 170° C. and a pressure of about 250 psig and such that sodium sulfide content of said dreg containing white liquor is substantially converted to sodium sulfate.

8. The method of claim 5, wherein said oxidizing is at a temperature of between about 60° C. to about 110° C. and at a pressure of between about 70 psig and about 100 psig and such that sodium sulfide content of said dreg containing white liquor is substantially converted to sodium thiosulfate.

9. The method of claim 5, wherein said oxidizing is at a temperature of about 100° C. and a pressure of about 100 psig and such that sodium sulfide content of said dreg containing white liquor is substantially converted to sodium thiosulfate.

10. The method of claim 2 or claim 1 or claim 3, wherein said dregs are present within said dreg containing white liquor stream at a concentration of no more than about 10.0 grams/liter.

11. The method of claim 10, wherein said oxidizing is at a temperature of between about 120° C. to about 180° C. and at a pressure of between about 120 and 250 psig and such that sodium sulfide content of said dreg containing white liquor is substantially converted to sodium sulfate.

12. The method of claim 10, wherein said oxidizing is at a temperature of about 170° C. and a pressure of about 250 psig and such that sodium sulfide content of said dreg containing white liquor is substantially converted to sodium sulfate.

13. The method of claim 10, wherein said oxidizing is at a temperature of between about 60° C. to about 110° C. and at a pressure of between about 70 psig and about 100 psig and such that sodium sulfide content of said dreg containing white liquor is substantially converted to sodium thiosulfate.

14. The method of claim 10, wherein said oxidizing is at a temperature of about 100° C. and a pressure of about 100 psig and such that sodium sulfide content of said dreg containing white liquor is substantially converted to sodium thiosulfate.

* * * * *